US006812840B2

(12) United States Patent
Gehlot et al.

(10) Patent No.: US 6,812,840 B2
(45) Date of Patent: Nov. 2, 2004

(54) OBJECT AREA NETWORK

(75) Inventors: Narayan L. Gehlot, Sayreville, NJ (US); Victor B. Lawrence, Holmdel, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/055,471

(22) Filed: Jan. 23, 2002

(65) Prior Publication Data

US 2003/0137419 A1 Jul. 24, 2003

(51) Int. Cl.[7] ..... G08B 13/14

(52) U.S. Cl. ..... 340/572.1; 340/573.1; 340/825.36

(58) Field of Search ..... 340/572.1, 572.7, 340/572.8, 573.1, 825.36, 825.38, 825.49

(56) References Cited

U.S. PATENT DOCUMENTS 4,833,452 A * 5/1989 Currier ..... 340/539
4,961,575 A * 10/1990 Perry ..... 273/460
5,825,283 A * 10/1998 Camhi ..... 340/438
5,952,959 A * 9/1999 Norris ..... 342/357.08
6,198,394 B1 * 3/2001 Jacobsen et al. ..... 340/573.1
6,373,430 B1 * 4/2002 Beason et al. ..... 342/357.09
2002/0008625 A1 * 1/2002 Adams et al. ..... 340/573.1

* cited by examiner

*Primary Examiner*—Toan N. Pham

(57) ABSTRACT

A monitoring and tracking system for monitoring and tracking an object may have a plurality of object area network elements. Each of the object area network elements may have a wireless communications unit and a GPS unit, wherein the GPS units are designed to facilitate the calculation of position data for each of the plurality of object area network elements. The wireless communications units may be designed to facilitate communications between the plurality of object area network elements and at least one base station. Each of the plurality of object area network elements may further have a sensor unit, the sensor units each having at least one temperature sensing unit for obtaining temperature data and at least one pressure sensing unit for obtaining pressure data. The object area network elements may be designed to communicate the temperature data, the pressure data, and the position data to the base station. The plurality of object area network elements may also be designed to communicate with each other to form an object area network.

30 Claims, 5 Drawing Sheets

OBJECT AREA NETWORK

FIELD OF THE INVENTION

The present invention relates to methods of monitoring and tracking people and objects.

BACKGROUND OF THE INVENTION

Monitoring and tracking persons and objects has become a significant concern. When children travel alone, either to school or to other activities, they are often in danger of being abducted or otherwise accosted. With more and more parents working, children tend to spend more time traveling and moving about without adequate supervision. Parents require a way to monitor the safety of their children, and track their whereabouts.

Many elderly adults live alone and away from their children. These elderly adults often suffer from incapacitating health emergencies such as heart attacks, strokes, dizziness, or other such ailments, and may need assistance. On other occasions, these persons may become disoriented or lost, and may not be able to find their way home.

Also, due to the general workings of the penal system, and also due to overcrowding of prisons, many dangerous persons are being released from prisons and allowed to travel in society. There is a need to be able to track these persons, so that they may travel about society, while still being monitored and tracked to provide safety for those around such persons.

Many of the devices and methods currently available for monitoring and tracking persons may have deficiencies. Methods presently used for monitoring and tracking include the use of audio and visual baby monitors for monitoring babies, ID tags for children, video cameras, access badges and use of security guards around schools.

With respect to the elderly, devices exist whereby a person may manually trigger an alarm condition by pressing a button. These devices have limitations, however, when the monitored person is incapacitated, or if the monitored person travels outside a local designated area.

With regard to monitoring potentially unsafe persons who have been released from prison, methods of protecting others from such persons include signs around schools stating that an area is a drug-free school zone, fliers and notices being distributed to residents when a past offender moves into a neighborhood and other similar systems.

Some of the shortcomings of the systems are related to the fact that these methods are limited in the amount of protection they provide, because: a) they are prone to false alarms and failures; b) adults or other parties are not alerted to a problem automatically, or in a real time basis; c) they are restricted in a geographic area of protection; and d) it is often difficult to inform a potential victim of impending danger.

SUMMARY OF THE INVENTION

A person or object may be monitored or tracked by way of the use of two or more object area network elements. The object area network elements may be placed on or near the person or object. The object area network elements are devices that may communicate and share information with each other to form an object area network. The object area network is a local area network whereby the object area network elements located on the monitored person may inter-communicate. Information may be shared between the object area network elements via inter-element communication over the object area network. Further, the shared information from the local object area network located on the person may also be communicated to a remotely located base station via a wireless communication network such as a cellular communications network.

Biometric and other data related to the object or person may be 1) obtained by sensors on the object area network elements; 2) shared on the object area network; and 3) communicated by wireless communications to a base station. The object area network elements may also be capable of a) obtaining position data related to the object or person; b) sharing the information over the object area network; and c) communicating the position data to a base station. Additionally, the object area network elements may have an alerting unit whereby a person may be alerted to a dangerous situation by communications from a base station.

Advantageously using two or more object area network elements, a monitoring and tracking system is formed that is less prone to false alarms and failures, because multiple networked object area network elements are used. Multiple object area network elements provide system redundancy and the ability to share information between the multiple object area network elements, thus reducing the occurrence of false alarms triggered from an erroneous reading from a single unit. Additionally, adults or other parties may be alerted to a problem automatically, or on a real-time basis. Further, the use of a positioning system on the object area network elements allows for monitoring that is unrestricted as to the geographic area of protection. The area of protection is unrestricted because, as a monitored person's position is tracked via a positioning system, communications between the object area network and a base station may be accomplished via a wireless communication means, such as a cellular communication network, as the monitored person moves from place to place. Still further, if a monitored person is in danger, he or she may be informed of an impending danger via an alerting unit located on one or more of the object area network elements.

Working together as an object area network, object area network elements may monitor a person by the use of sensors, track the person by the use of a global positioning system (GPS) receiver system, share information by way of inter-element communication units, and/or communicate information to a base station via a wireless communication unit. By inter-communicating via wireless or other means and working as an object area network, the object area network elements may also track a person while each of the object area network elements may monitor and also track operability of, and share information with, the other object area network elements via the inter-element communication units and the object area network. In this manner, monitoring and tracking performance are improved, while false alarms and inaccurate data are minimized.

Thus, a person carrying/wearing the object area network can be tracked by either or both positional and biometric information. Deviation from known geographic or biometric parameters can trigger alarms or initiate emergency communications.

BRIEF DESCRIPTION OF THE DRAWINGS

In the drawing figures, which are not to scale, and which are merely illustrative, and wherein like reference characters denote similar elements throughout the several views.

DETAILED DESCRIPTION OF THE INVENTION

Figure 1:
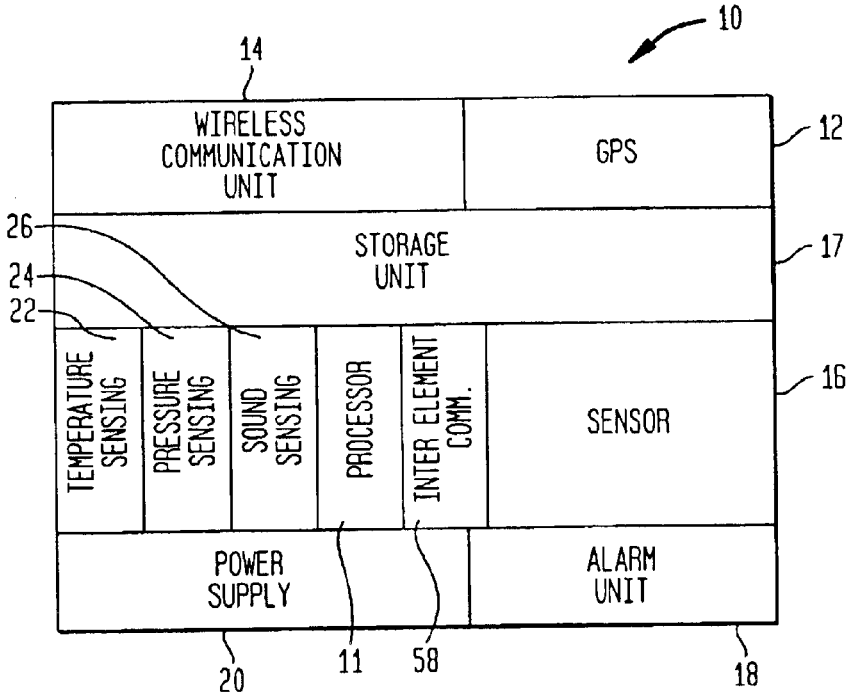
FIG. 1 is a schematic diagram of an object area network element of the present invention.

Referring to FIG. 1, an object area network element 10 is shown. Object area network element 10 may have a Global Positioning System (GPS) unit 12 for calculating the position of the object area network element in connection with global positioning satellites. GPS unit 12 may be designed in any manner known to those skilled in the art. In an exemplary embodiment, all or a unit of object area network element 10, including GPS unit 12, may be formed on an integrated circuit chip such that object area network element 10 may be small, unobtrusive, and easily and discreetly be placed or carried on a person's body or on or within an article of clothing.

Object area network element 10 also may have processor unit 11, which may be a microprocessor or similar electronic processing unit as is known in the art. Processor unit 11 may work in conjunction with other units of object area network element 10, or other similar object area network elements, and may include, for example, GPS unit 12, in order to perform calculations, algorithms, and other operations as part of the function of object area network element 10. Storage unit 17 may be used to store information pertinent to the function of object area network element 10. Storage unit 17 may be a Ready Access Memory (RAM) unit or any other storage unit capable of storing information electronically, as is known to those skilled in the art. Power supply unit 20 may supply electrical power which may be used by the other units of object area network element 10 such as, for example, GPS unit 12, processor unit 11, storage unit 17, as well as other units of object area network element 10 discussed below. Power supply unit 20 may be, for example, a battery such as a nickel cadmium type, or a lithium ion type, or any other power supply unit as would be known by one skilled in the art. In an exemplary embodiment, power supply unit 20 may be relatively small so that it may be disposed on object area network element 10 with the total size of object area network element 10 such that it may be placed unobtrusively in clothing or on a person's body. In an exemplary embodiment, power supply unit 20 may be of a type wherein the power level remains at an operable level for a relatively long period of time such that replacement or recharging is only infrequently necessary.

Object area network element 10 may also have wireless communication unit 14, which may facilitate communications via a cellular or other wireless network between an object area network element 10 and a base station, other object area network elements, or any other device capable of communicating via a wireless communications network. Wireless communications unit 14, as discussed above with respect to other units of object area network element 10, may be small enough to be disposed on an integrated circuit chip for easy and unobtrusive placement on clothing or parts of the human body, or other objects.

Object area network element 10 may also have sensor unit 16. Sensor unit 16 may, in turn, have various sensing units used to gather information related to the monitored person as well as the environment surrounding such a person. Sensor unit 16 may include temperature sensing unit 22. Temperature sensing unit 22 may be of a type capable of sensing the body temperature of the monitored person. Additionally, multiple temperature sensing units may be used so that the temperature of the surrounding air or environment may also be sensed. Temperature sensing unit 22 may be of any type known to those skilled in the art, its design being a matter of application-specific design choice. Sensor unit 16 may also have pressure sensing unit 24 which may sense the atmospheric pressure in the surrounding environment of the object area network element 10 and thus around the monitored person. Pressure sensing unit 24 may also facilitate the monitoring of a heart rate, or other vital functions of a monitored person. Pressure sensing unit 24 may be any type known to those skilled in the art and its specific design is a matter of application specific design choice. Sensor unit 16 may also have sound sensing unit 26, which may be capable of sensing sounds from the monitored person as well as from the surrounding environment. Sound sensing unit 26 may be a miniature microphone or other such sensing unit, as may be determined by one skilled in the art as a matter of application specific design choice. Object area network element 10 may also have alerting unit 18, which may be used by the monitored person in order to manually alert others of an impending dangerous situation or other such circumstances. In an exemplary embodiment, alerting unit 18 may be a miniature push button, microswitch, capacitive sensor, thermal sensor, or other such button or unit that may be easily triggered by a touch from the monitored person.

In an exemplary embodiment, object area network element 10, and all components thereof, may be combined such that all or most elements are on a single integrated circuit chip, or at least in the same package or housing. This chip may be easily disposed on or within the monitored person's clothing, or easily and unobtrusively affixed to a unit of the monitored person's body, or even implanted beneath the skin of the monitored person.

Figure 2:
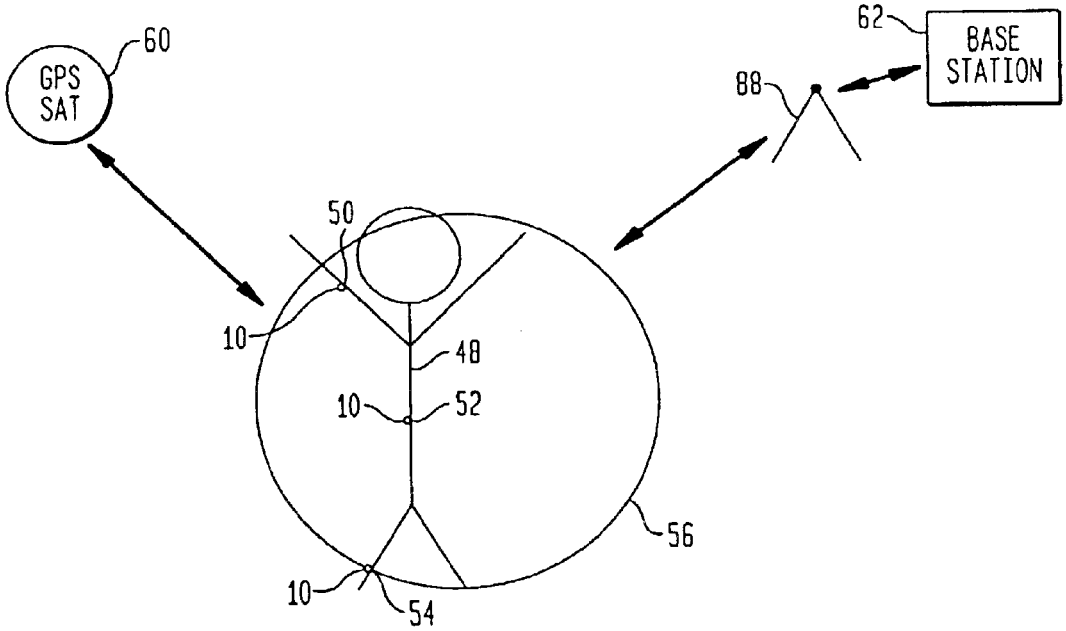
FIG. 2 is a schematic diagram of a person using an object area network of the present invention.

Referring to FIG. 2, in an exemplary embodiment, multiple object area network elements 10 may be used with a monitored person or object 48. An object area network system may have, for example, a first object area network element 50, a second object area network element 52 and a third object area network element 54. In an exemplary embodiment, first, second and third object area network elements 50, 52, 54 may be disposed over a relatively wide area of monitored person's 48 body. For example, object area network element 50 may be disposed on the upper unit of the monitored person's 48 body, such as near the wrist, arm, neck, head, shoulder, or chest. Second object area network element 52 may be disposed near the middle of monitored person's 48 body such as near the waist, or stomach. Third object area network element 54 may be disposed near the lower unit of the monitored person's 48 body such as near the knees, ankles, feet, calves, or other body parts on the lower unit of monitored person's 48 body.

Object area network elements 10 may be disposed directly on the monitored person's 48 body, or may be placed on or integrated into a monitored person's 48 clothing. For example, the object area network elements 10 may be integrated into a hat, shirt, belt, pants, socks, shoes, gloves, or other articles of clothing worn by the monitored person. An object area network element 10 may also be affixed to a monitored person's 48 skin at any of these locations, such as the arm, hand, wrist, chest, leg, feet, or other body parts. In an exemplary embodiment, object area network element 10 may be placed such that biometric information regarding the monitored person 48, such as body temperature, heart rate, and sound made by the monitored person 48 may be sensed by object area network element 10. Further, in an exemplary embodiment, information regarding the environment surrounding the object area network element 10 and monitored person 48 may also be sensed, such as the ambient temperature of the air, sound in the surrounding environment, or the atmospheric pressure in the surrounding environment. In an exemplary embodiment, object area network elements 10 may be small enough such that they may be unobtrusively disposed on the monitored person's 48 body or on or within the monitored person's 48 clothing, such that monitored person's movements and daily activities are not interfered with, and the object area network elements 10 are not easily discernible or viewable by other persons, such as a potential attacker. Further, since object area network elements 10 may be integrated into articles of clothing and also since multiple object area network elements 10 may be used within an object area network system on a monitored person 48, it may be difficult and time consuming for a potential attacker to identify the location of, and remove or disable the multiple object area network elements 10 disposed near different regions of monitored person's 48 body. Also, since in an exemplary embodiment, the object area network elements 10 are disposed at different regions of monitored person's 48 body, a more reliable sampling of environmental and biometric information may be obtained than would be obtained from a sensor disposed at a single location of monitored person's 48 body. Also, if an object area network element 10, such as, for example, first object area network element 50, temporarily loses sensor contact with monitored person's 48 body, the other object area network elements 10, such as, for example, second object area network element 52 and third object area network element 54, may continue to receive sensor information regarding monitored person 48. This ability to continue the monitoring of the monitored person 48, while an object area network element temporarily loses sensor contact with the monitored person 48, facilitates the minimizing of false alarms that may be triggered by a monitoring system that only uses a single monitoring element.

First object area network element 50, second object area network element 52, and third object area network element 54 wirelessly communicate with each other via local object area network 56. By communicating via local object area network 56, first object area network element 50, second object area network element 52, and third object area network element 54 may continuously check on the status and functionality of the other object area network elements 10 in object area network 56 in order to facilitate the working and operation of the system. In an exemplary embodiment, each object area network element 10 may have an inter-element communication unit 88 (see FIG. 1). Object area network elements 10 may wirelessly communicate with each other via inter-element communication units 58, forming local object area network 56. Inter-element communication units 58 may be, for example, Radio Frequency (RF) devices, Infrared (IR) devices, or other short-range wireless communication devices such as those using the BLUETOOTH® communication technology and protocol. Additionally, object area network 56 may be formed via other wireless network communications devices as is known by those skilled in the art. Further, object area network elements 10 may communicate via local object area network 56 by use of wireless communications, whereby inter-element communication units 58 and wireless communications units 14 operate as a combined communication device. The use of local object area network 56 allows the object area network elements 10 to work together, using the inter-element communication units 58, and to compare sensed information in order to average sampled data, such as body temperature, and also to minimize false alarms if one object area network element 10 is temporarily malfunctioning or is removed from misses sensory contact with the monitored person's 48 body or the ambient environment.

Each object area network element 10, by use of its wireless communications unit 14, may communicate via a wireless communications network, and, for example, a first wireless communications tower 88 to a base station 62. It may be noted that this communication between the wireless communication unit 14 of an object area network element 10 and a base station 62 may be separate and distinct from the local network communications between the object area network elements 10 via inter-element communication units 58.

By way of this wireless communication with a base station 62, pertinent biometric data from the monitored person 48, as well as data from the ambient environment may be automatically and continuously monitored via a wireless communications network at base station 62. In this manner, a person having a heart attack, or being abducted, may have his or her information automatically sent to base station 62 so that the proper steps to remedy the emergency situation may be initiated. Base station 62 may be a private or a public entity or agency set up for the monitoring of persons. In addition, wireless communications may be with a parent of a small child or the adult child of an elderly adult person or parent, or any other person endeavoring to monitor monitored person 48, so that monitoring may be continuously and automatically achieved.

Each object area network element 10 may also communicate, via its respective GPS unit 12, with a global positioning satellite 60 in order to accurately track the position of the object area network elements 10 and thus the monitored person 48.

Figure 3:
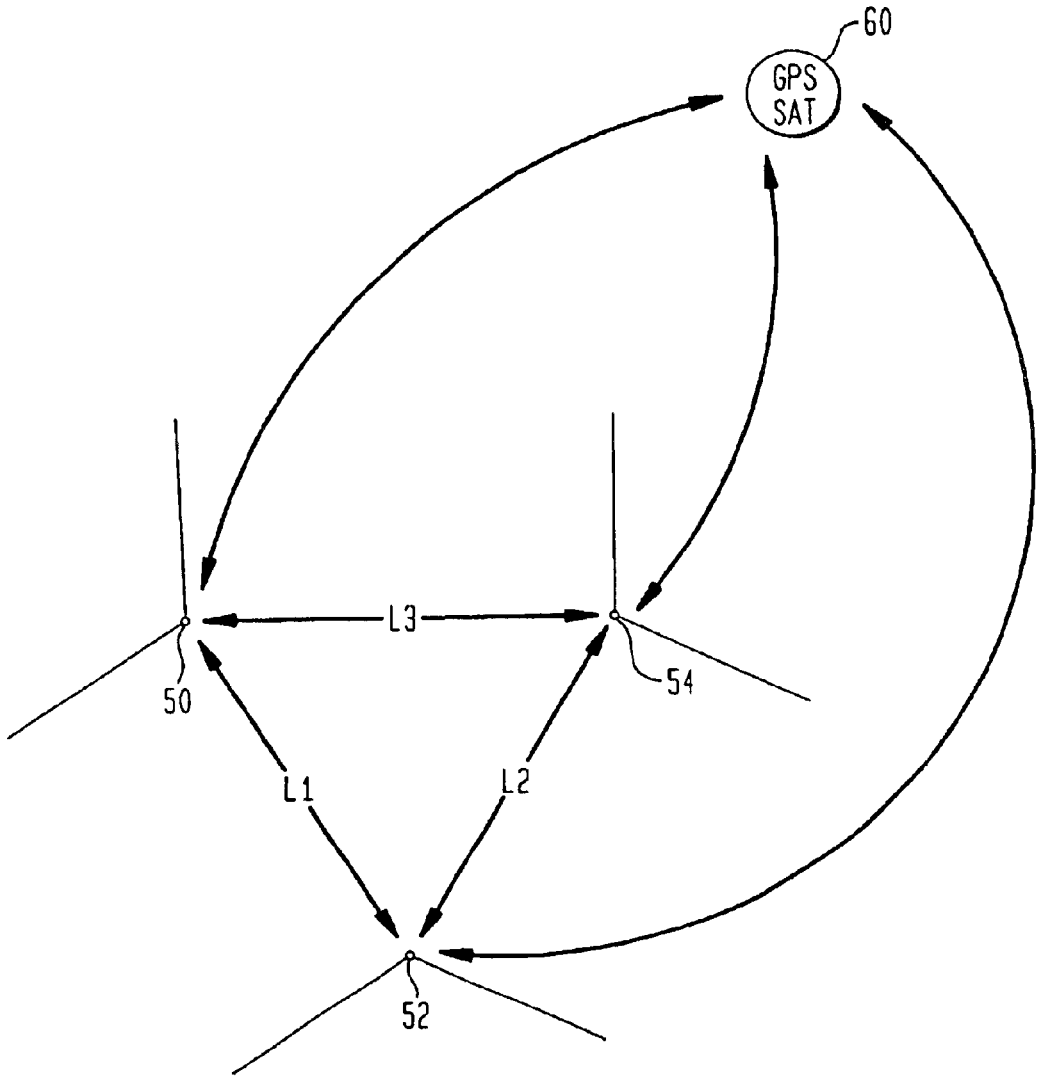
FIG. 3 is a schematic diagram depicting distance relationships between the object area network elements of the present invention.

Turning to FIG. 3, first object area network element 50, second object area network element 52, and third object area network element 54 each may communicate via their respective GPS units 12 with the global positioning satellite 60, as is known in the art, in order to calculate the position of each of the first, second and third object area network elements 50, 52, 54. In this manner, when an emergency situation is sensed by object area network elements 50, 52, 54, the position of monitored person 48 may also be transmitted to base station 62 so that a proper response, such as a visit by police or an ambulance may be directed to the proper location quickly and efficiently. Since each of the first, second and third object area network elements 50, 52, 54 may independently calculate its position via its respective GPS unit 12, the first, second and third object area network elements may also calculate the respective distances between each of the object area network elements 50, 52, 54. For example, distance L1 may be the distance between first object area network element 50, and second object area network element 52, while distance L2 may be the distance between second object area network element 52 and third object area network element 54, and distance L3 may be the distance between third object area network element 54 and first object area network element 50. By calculating the relative distances between the first, second and third object area network elements, 50, 52, 54, an emergency situation may be triggered if one of the object area network elements 10 is removed from the monitored person 48 as monitored person 48 is abducted. If, for example, an attacker abducts a child who is being monitored, and the attacker removes one of the object area network elements 50, 52, 54, but does not locate or have enough time to remove the other object area network elements, as a child is abducted, an emergency situation may be triggered as the relative distances between the first, second and third object area network elements 50, 52, 54 will indicate that an emergency situation has occurred. Additionally, monitored person 48 may have the ability to remove one of the object area network elements 50, 52, 54 such as, for example, third object area network element 54 from monitored person's 48 sneaker, so that monitored person 48 may, for example, wade in knee deep water at a pool or lake while leaving third object area network element 54 on the shore. In this scenario, first, second and third object area network elements 50, 52, 54 may calculate the respective distances between the elements and factor into the calculations that one of the object area network elements 50, 52, 54 is at a greater distance from the monitored person 48 than the other two, so that monitored person 48 may undertake an activity such as wading in knee deep water without triggering a false alarm when removing one of the object area network elements 50, 52, 54.

Figure 4:
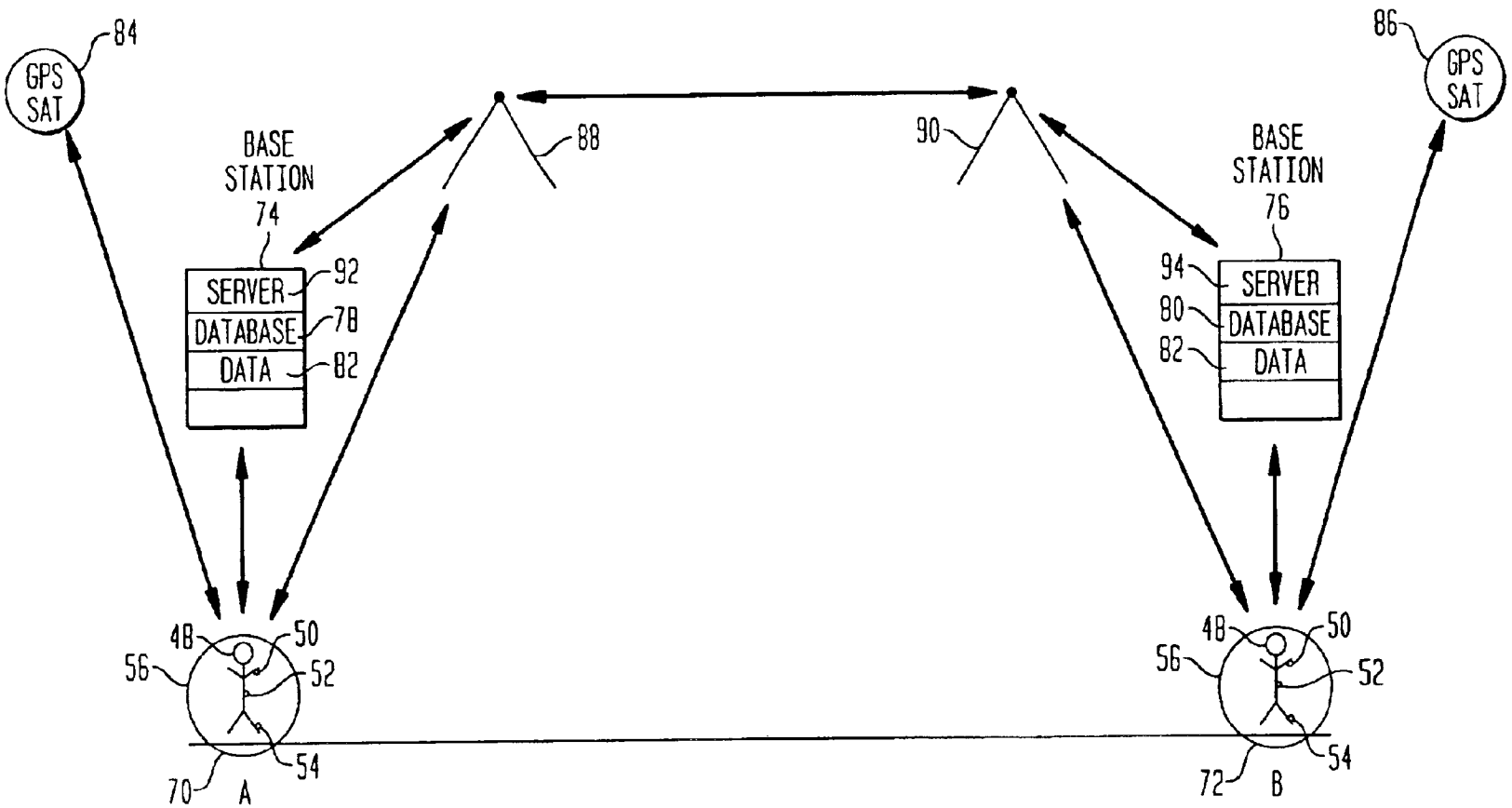
FIG. 4 is a schematic diagram depicting a dynamic database in accordance with the present invention.

Referring to FIG. 4, there is shown a monitored person 48 located at a first location A. Monitored person 48 may have, disposed on or near his or her body first object area network element 50, second object area network element 52 and third object area network element 54. As described above, the first, second and third object area network elements 50, 52, 54 may communicate with each other via wireless local object area network 56. Object area network elements 50, 52, 54 may calculate their position or geographic location by way of GPS units 12 (see FIG. 1) which may communicate with a global positioning satellite such as, for example, first global positioning satellite 84. Object area network elements 50, 52, 54 may alternatively communicate, using wireless communication units 14, via a cellular or wireless communications network and, for example, first wireless communications tower 88.

Personal data 82 of monitored person 48 may be stored in a first database 78. Personal data 82 may consist of any pertinent information related to monitored person 48. Personal data 82 may include, but is not limited to, monitored person's 48 body temperature, pulse rate, speech patterns, and other pertinent biometric information. Also included in the personal data 82 may be notes normally taken during travel, areas of location which may be off limits, other persons whom monitored person 48 should not approach or be close to, as well as other pertinent information. Additionally, other information may be part of personal data 82, such as, for example, monitored person's 48 social security number, driver license information, automobile registration information, banking information, and emergency contact information. Personal data may also include data required for presentations or conferences.

Personal data 82 may be located in first dynamic database 78. First dynamic database 78 may be stored in first server 92 which, in turn, may be disposed in first base station 74.

In an exemplary embodiment, first dynamic database 78 may be a relational database as is known by those skilled in the art, such that personal data 82 of monitored person 48 may be stored, referenced, and updated. First server 92, may be a computer server capable of storing the personal data 82 in first dynamic database 78, as is known in the art. The specific choice of computer server is a matter of application specific design choice.

As personal data 82 of monitored person 48 may be stored in first dynamic database 78, the monitoring of monitored person 48 may be facilitated. For example, if monitored person 48 is a child, common or approved routes that the child may take, such as the trip from home to school, may be stored in personal data 82 of first dynamic database 78. If the child were to stray from the approved route because of, for example, becoming lost, or due to being abducted by an attacker, the position of the child could be determined by object area network elements 50, 52, 54 in first global positioning satellite 84. The location of the child could be compared with information stored in personal data 82 and if the position of the child were to deviate from an approved route stored in personal data 82, an alarm situation may be triggered with the proper response, such as the police or a rescue squad, being directed to the location of the child. Alternatively, a similar monitoring scenario could take place if monitored person 48 were an elderly person who were to become disoriented or lost and not able to find his or her way home. As described above with respect to the tracking of the child, the location of the elderly person could be determined and assistance could be dispatched.

Further, if monitored person 48 were to be in an automobile accident or other accident wherein monitored person 48 were to become unconscious or otherwise incapacitated, the identity of monitored person 48, as well as any pertinent medical information, such as drug allergies, or medical conditions could be stored in personal data 82 and thus accessed by the proper authorities so that monitored person 82, although unconscious or incapacitated, could be helped and attended to. Still further, in case of such an emergency, monitored person's 48 family could be automatically alerted to the emergency situation so that the injured person may not be considered to be missing or unidentified for an undue period of time.

Also, with regard to monitoring biometric characteristics of monitored person 48, to determine if a medical emergency has occurred such as, for example, if the pulse rate is indicative of a heart attack or other serious condition, proper authorities may be alerted, so that help, such as an ambulance, may be automatically, efficiently, and quickly dispatched. Information included as part of personal data 82 and first dynamic database 78 may be communicated to and from object area network elements 50, 52, 54 via wireless communications. Different biometric profiles based on the activities that monitored person 48 is undertaking may be used. For example, if monitored person 48 is sitting at a desk, a certain heart rate may be considered normal. However, if monitored person 48 is, for example, jogging, which could be determined through GPS unit 12 and global positioning satellite 84, a different heart rate profile may be taken from personal data 82 and dynamically updated on object area network elements 50, 52, 54 such that a false alarm on an increased heart rate or body temperature would not occur.

Accordingly, by having personal data 82 stored in first dynamic database 78, monitored person 48 does not need to carry on his or her person information regarding medical histories, automobile information, social security information, and banking information.

If monitored person 48 were to travel from location A located, for example, on the East Coast of the United States to location B located, for example, on the West Coast of the United States, monitored person's 48 movements may be tracked by use of GPS units 12 on object area network elements 50, 52, 54 in conjunction with first global positioning satellite 84 and second global positioning satellite 86. Further, while the positioning system has been described with respect to a first and second global positioning satellite and first and second communications towers for descriptive purposes, the present invention may be used in conjunction with more than two satellites or towers, the specific number used being a matter of design choice as is known by those skilled in the art.

In an exemplary embodiment, as monitored person 48 moves from location A to location B, the personal data 82 related to monitored person 48 may move from first dynamic database 78, located in first server 92, located in first base station 74, located relatively within the geographic region of location A, to second dynamic database 80 located in second server 94 which, in turn, is located in second base station 76. Personal data 82 may be moved or transferred from first dynamic database 78 to second dynamic database 80 via a wireless communications network or other known network. In this manner, personal data 82 of monitored person 48 may follow monitored person 48 as he or she moves from location A to location B. Accordingly, if monitored person 48 were to travel from location A on, for example, the East Coast of the United States, to location B at, for example, the West Coast of the United States, monitored person's 48, personal data 82 would follow monitored person 48 in his or her travels and would be stored in second dynamic database 80 relatively locally to monitored person's 48 location.

If monitored person 48 were to have an emergency situation such as an accident, where monitored person 48 to become unconscious or incapacitated, while in location B, the pertinent information and help could be accessed quickly by having personal data 82 stored in second dynamic database 80 located relatively close to the actual position of monitored person 48 at location B. In an emergency situation, the proper authorities, such as an ambulance squad or police, may be notified from second base station 76 so that assistance may be quickly and efficiently provided.

By having personal data 82 follow monitored person 48 from location A to location B, communication pathways, such as communication networks, may be freed up as less wireless traffic is created when personal data 82 in second dynamic database 80 is accessed through second wireless communications tower 90 when monitored person 48 is at location B than if personal data 82 were to be accessed from first dynamic database 78 located nearer to location A. In other words, if personal data 82 must be retrieved from a relatively far location, more communications traffic is created as the signal must be relayed through multiple cellular or wireless communication cells or hops and any necessary intervening communication networks. Also, by having personal data 82 stored at a location relatively close to the position of monitored position 48, the speed of communication between object area network elements 50, 52, 54, or any authorized third party, and the personal data 82 may be increased.

While the communication pathway is described as being a cellular communications network, other communications networks, such as satellite communications, other wireless communications systems, telephone communications, or computer network communications may be used as well. In addition, a single type of communications network need not be used, as a combination of communication networks may be employed. The type or combination of type of communications networks being used is an application specific matter of design choice.

In an exemplary embodiment, wireless communications network traffic may also be reduced by moving personal data 82 from first dynamic database 78 to second dynamic database 80 during off peak or low traffic time periods. If, for example, monitored person 48 moves from location A to location B, this movement may be tracked by GPS units 12 on object area network elements 50, 52, 54 and the first global positioning satellite 84, and second global positioning satellite 86. If this movement takes place during a peak communications time period or a high communication traffic period, movement of personal data 82 from first dynamic database 78 to second dynamic database 80 may be delayed such that personal data 82 is moved during a relatively low communications traffic time period so that communication traffic minimization is facilitated. In this manner, data may be moved, copied or transferred without the high cost of peak time usage of communications networks.

In an exemplary embodiment of the invention, movement of personal data 82 may be based on the predicted movement of monitored person 48. The movement of monitored person 48 may be predicted based on information such as, for example, air travel reservations, car rental reservations and hotel reservations. Additionally, the movement of monitored person 48 may be predicted based on the past travel history of monitored person 48.

Further, referring again to FIG. 4, if personal data 82 is moved from first dynamic database 78 to second dynamic database 80, this information may be deleted from first dynamic database 78 so that redundant information need not be stored. The personal data 82 may be moved, copied or transferred temporarily, or for relatively long or short periods of time, as a matter of application specific design choice, as would be determined by one skilled in the art. Once monitored person 48 returns from location B back to location A, personal data 82 may be moved from second dynamic database 80 back to first dynamic database 78 with the personal data 82 being deleted from second dynamic database 80. In this manner, in addition to facilitating the quickening of communications between the stored personal data 82 and the object area network elements 50, 52, 54, and minimizing wireless communications traffic, the need for permanent computer storage capabilities is minimized as personal data 82 moves with monitored person 48 and is only stored at a location near monitored person 48, with personal data 82 being deleted from other locations so that overall storage and computer capacity may be used more efficiently. Additionally, personal data may be moved during times of non-peak communications traffic to lessen communication traffic, and reduce the cost of transferring the personal data 82. Remote database storage could be rented in advance, with needed data being transferred during low cost off-peak times, before it is actually needed.

While the above described examples have been directed to a scenario with only two locations, location A and location B, for ease of explanation and simplicity of discussion, the dynamic database system may be used in conjunction with a wide array of dynamic databases located throughout a region, country, or throughout the world. Dynamic databases might be located, for example, in each county or in each state. In an exemplary embodiment, dynamic databases may be set up in a hierarchical topology wherein servers are located at the county level at one hierarchic level and then at the state level at another hierarchic level with information being transferred from a county level to a state level and then to another county or state dynamic database.

Alternatively, personal data 82 may be stored in multiple dynamic databases if monitored person 48 were to frequently visit a certain geographic location or region. Personal data 82 may be retained for a certain amount of time before being deleted. In this manner, an efficient balance between total storage usage (at the various server locations) and the limiting of communication network traffic may be achieved.

In an exemplary embodiment, personal data 82 may follow monitored person 48 in his or her travels, continuously and automatically, without the need for manual adjustment or updating of databases. As monitored person's 48 location is tracked during his or her travels, personal data 82 may be automatically and continuously referenced and updated. The personal data may also be transferred based upon predicted movement of the monitored person 48.

Figure 5:
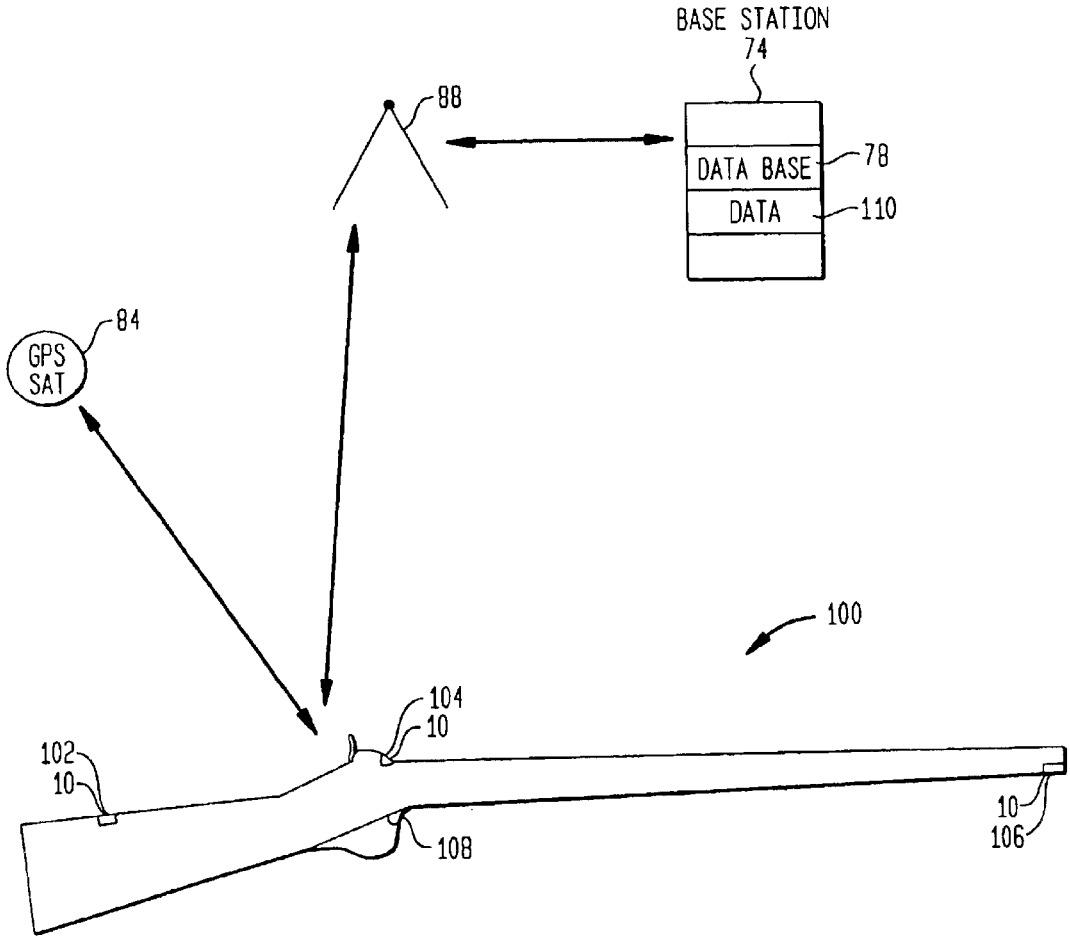
FIG. 5 is a schematic diagram of an object having object area network elements disposed thereon for use with a space area network of the present invention.

While object area network elements 10 have been described with respect to monitoring and tracking persons, in another embodiment, object area network elements 10 may be used to monitor objects other than persons. Turning to FIG. 5, a gun or unwanted object 100 is shown. A first unwanted object sensor 102, a second unwanted object sensor 104, and a third unwanted object sensor 106 may be disposed on unwanted object 100. Unwanted object sensors 102, 104, 106 may be temperature sensors, pressure sensors, or other sensing units. The temperature and pressure sensors may be any type suitable for the application as would be determined as a matter of application specific design choice by one skilled in the art. In an exemplary embodiment, unwanted object sensing units 102, 104, 106 may be disposed on an integrated circuit chip having dimensions such that unwanted object sensor units 102, 104, 106 may be integrated into the unwanted object or gun 100. In an exemplary embodiment unwanted object sensors 102, 104, 106 may be disposed on object area network elements having, in addition to a temperature sensing unit 22 and a pressure sensing unit 24, a GPS unit 12 for determining the positioning of the unwanted object 100 as well as a wireless communications unit 14 for communicating with a base station via a wireless communications network.

In an exemplary embodiment, unwanted object sensors 102, 104, 106 may monitor changes in pressure and temperature such that when a gun or unwanted object 100 is fired or discharged, the temperature and pressure sensors 102, 104, 106 would be triggered.

In an exemplary embodiment, when unwanted object 100 is fired, and sensors 102, 104, 106 detect the firing, the position of unwanted object 100 may be determined by GPS unit 12 of object area network element 10 and this data may be communicated via wireless communications unit 14 via a wireless communications network to a first base station 74. Unwanted object 100 may have corresponding unwanted object data 110 stored in first dynamic database 78 and first base station 74. When unwanted object 100 is fired, the information regarding the firing of unwanted object 100, as well as its position, may be updated and unwanted object data 110 in first dynamic database 78.

Unwanted object data 110 may include to whom the gun 100 is registered, as well as areas where unwanted object 100 is permitted to be taken, as well as locations where unwanted object 100 is not permitted to be taken. Also, the position of unwanted object 100 may be determined and if unwanted object 100 is in a location where firing should not take place, such as in a school zone, emergency personnel such as an ambulance squad or the police may be dispatched to the location of unwanted object 100.

Further, if unwanted object data 100 includes owner registration information, and the registered owner of unwanted object 100 has object area network elements disposed on his or her person, as discussed above, relative locations of the registered owner of unwanted object 100 and the location of unwanted object 100 may be calculated to determine if the owner of unwanted object 100 is in the vicinity of unwanted object 100 or if unwanted object 100 may have been stolen or otherwise removed from the possession of the owner of unwanted object 100.

In an exemplary embodiment, a child may be a monitored person 48, having object area network elements disposed on his or her person such that the monitored person 48 may be tracked via a GPS receiver system. Automatic monitoring may be initiated whereby the position of unwanted object 100 is monitored with respect to the position of monitored person or child 48, such that if unwanted object 100 were to come within a distance determined to be too close to monitored person or child 48, an emergency condition would be initiated and the proper authorities, such as the police, could be quickly dispatched to the location of the child. Additionally, if respective locations of the monitored person or child 48 and the unwanted object 100 are determined at timely intervals, the relative velocity vectors of the two may be calculated such that a meeting of the monitored person 48 and the unwanted object 100 may be anticipated before a critical distance is reached. Additionally, ex-convicts may be fitted with the object area network elements as part of an early release or parole requirement. In an exemplary embodiment, besides monitoring the position of an ex-convict, the position of the ex-convict now may be calculated with respect to the location of unwanted object 100, such that if the distance between the two becomes too small, indicating that an ex-convict has unwanted object 100 in his or her possession, the proper authorities, such as the police, may be automatically dispatched in a timely and efficient manner.

Additionally, unwanted object 100 may be fitted with unwanted object disabling unit 108 which may be remotely activated via the wireless communications network such that if it is determined that unwanted object 100 is in the wrong hands, unwanted object 100 may be remotely disabled via unwanted object disabling unit 108.

Additionally, the monitored person or potential victim 48 may be alerted to the presence of unwanted object 100 via wireless communication to an object area network element on the potential victim's person via the alerting unit 18 of object area network element 10. Alerting unit 18 may be a speaker capable of sounding an alarm or a speaker that would allow monitored person 48 to communicate via a wireless communications network and give voice instructions or alternatively, alerting unit 18 of object area network element 10 may be a flashing light, or vibrating unit as is used in pagers, a thermal unit that changes temperature to alert the potential victim or any other alerting unit as is known by those skilled in the art.

In an exemplary embodiment, sensing units 102, 104, 106 and object area network elements 10 on unwanted object 100 may be integrated into unwanted object 100 such that they may not be easily removed and, if they are removed, unwanted object 100 may be disabled.

Figure 6:
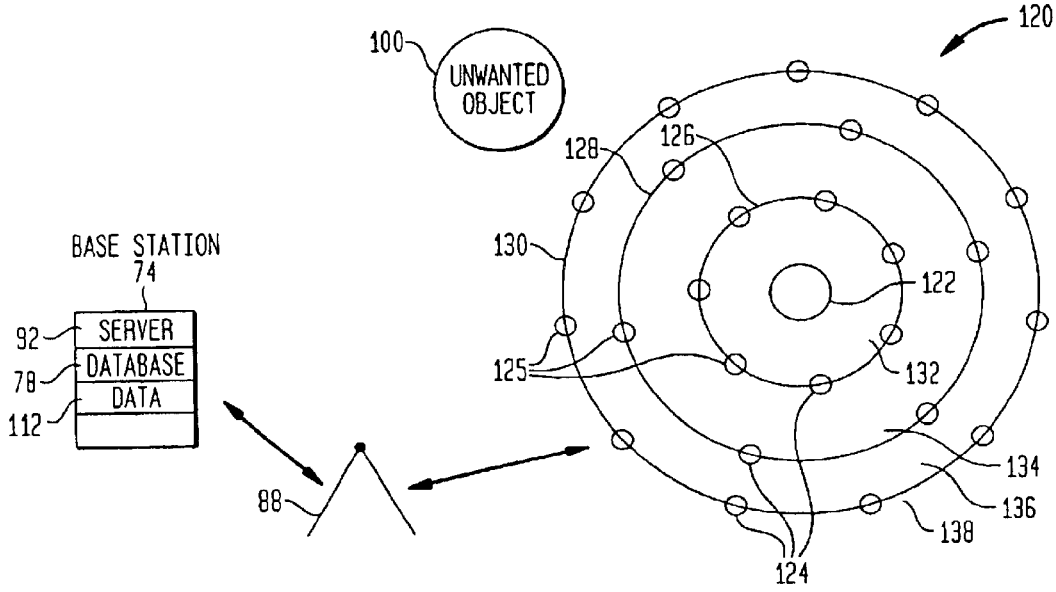
FIG. 6 is a schematic diagram depicting a space area network in accordance with the present invention.

Turning to FIG. 6, another embodiment of the present invention is shown wherein a space area network is shown. In an exemplary embodiment, unwanted object or gun 100 may not have any sensors 102, 104, 106 or object area network elements 10, as described in the previous embodiments. The space area network may be disposed in order to facilitate protection of those people located at a safe location 122, such as a school, from a person carrying an unwanted object or gun 100. Space area network sensors may have inductive current sensors capable of sensing the amount of metals present in a small gun or unwanted object 100. Space area network sensors 124 may also have infrared (IR) sensors capable of sensing the body heat of a person. The IR sensors of space area network sensors 124 may be any type known to those skilled in the art, the exact specifications of which are a matter of application specific design choice. Space area network sensors 124 may also be formed on space area network elements 125 which may communicate via wireless communications with a base station 74 having a first server 92, having database 78 and space area network data 112.

In an exemplary embodiment, space area network elements 125 with space area network sensors 124 may be disposed in a pattern of concentric rings surrounding a safe location or school 122. In an exemplary embodiment, space area network elements and space area network sensors may be disposed in a first or inner sensor circle 126, a second or middle sensor circle 128 and a third or outer sensor circle 130. Sensor circles 126, 128, 130 define space area network regions such as, for example, first space area network zone 132, second space area network zone 134, third space area network zone 136 and outer space area network zone 138.

In an exemplary embodiment, space area sensors 124 and space area network elements 125 may be disposed buried under the ground such that they may not be easily identified or removed or tampered with by persons carrying an unwanted object or gun 100. Space area network elements 125 with space area network sensors 124 may be spaced about first, second and third sensor circles 132, 130, 128, such that the person trying to bring an unwanted object 100 near safe location or school 122 may trigger an inductive current sensor or IR sensor when traversing each of the sensor circles 126, 128, 130.

As the unwanted object 100 is detected passing outer third sensor circle 130, this information may be communicated via a wireless communications network to space area network data 112 and dynamic database 78. A precautionary alarm may be communicated at this time to the proper authorities such as police or to the occupants of safe location or school 122. Alternatively, if the outer third sensing circle 130 is traversed, no warning may be issued upon this situation. As the unwanted object 100 is brought across the second sensor circle 128, a heightened state of alarm may be automatically triggered to the proper authorities such as the police and to the occupants of safe location or school 122. Finally, if unwanted object 100 traverses first or inner sensor circle 126, a full state of emergency may be instituted and the proper authorities, such as the police, as well as the occupants of safe location or school 122, may be alerted to a full alarm situation. In this manner, many tragic shooting incidents at schools and other such locations may be avoided.

Additionally, if several unwanted objects 100 should pass through a sensor circle 130, the heightened state of awareness might be initiated.

Figure 7:
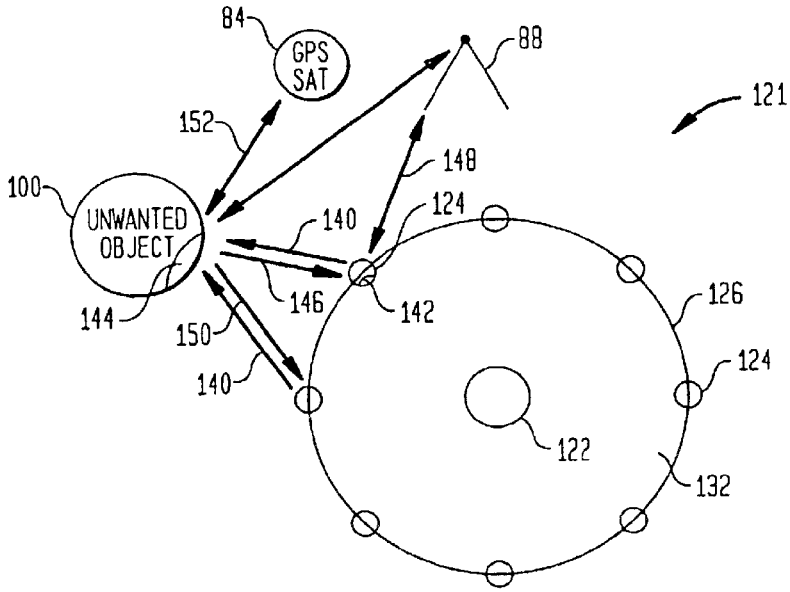
FIG. 7 is a schematic diagram depicting an exemplary embodiment of a space area network in accordance with the present invention.

Turning to FIG. 7, another embodiment of the present invention is depicted wherein a space area network 121 is shown. As in a previously discussed embodiment, space area network elements 124 may be disposed in a, for example, circular pattern such as first sensor circle 126 defining first safe zone 132 for the protection of safe location or school 122. As is the case with the above-discussed embodiment, the space area network 121 facilitates the protection of persons at safe location 122 from unwanted object or gun 100. As an alternative to, or in addition to, the use of inductive current sensors, however, space area network sensors each may have an interrogation unit 142. Interrogation unit 142 may transmit an interrogation signal 140 to facilitate identification of the presence of unwanted object 100. Interrogation signal 140 may be any signal suitable for determining the presence or proximity of unwanted object 100. Interrogation signal 140 may be, for example, an RF signal, an IR signal, or other suitable signal as is known by those skilled in the art.

Unwanted object 100 may have an identifier unit 144 for facilitating the identification of unwanted object 100 by a space area network sensor 124. Identifier unit 144 may be a passive transponder device of the type known in the art such that no signal is transmitted by identifier unit 144 unless interrogation signal 140 is received at unwanted object 100. In this embodiment, a space area network sensor 124 may transmit interrogation signal 140, and once this signal is received at unwanted object 100, identifier unit 144 may transmit response signal 146, which may in turn be received at a space area network sensor 124. In this manner, the space area network sensors 124 may identify the presence of an unwanted object 100. Once the presence of unwanted object 100 is detected, space area network sensor 124 may communicate via wireless communications path 148 and, for example, first wireless communications tower 88 to alert a base station 74 (see FIG. 4) so that the proper authorities, persons, or entities may be contacted.

Returning to FIG. 7, alternatively, identifier unit 144 of unwanted object 100 may be an active device, broadcasting announcement signal 150 at regular, predetermined, or otherwise initiated intervals. In this embodiment, identifier unit would not wait for interrogation signal 140 before transmitting, but could transmit announcement signal 150 at certain time intervals to facilitate the determination of the proximity of unwanted object 100 by safe area network sensors 124. Additionally, unwanted object 100 may have a GPS portion (not shown) for communicating with GPS satellite 84 via GPS communication path 152 to determine position information regarding unwanted object 100. Accordingly, the space area network may facilitate protection of those people located at a safe location 122, such as a school, from a person carrying an unwanted object or gun 100.

Thus, while there have been shown and described and pointed out fundamental novel features of the invention as applied to exemplary embodiments thereof, it would be understood that various omissions and substitutions and changes in the form and details of the disclosed invention may be made by those skilled in the art without departing from the spirit of the invention. It is the intention, therefore, to be limited only as indicated by the scope of the claim appended hereto.

What is claimed is:

1. A monitoring and tracking system for an object comprising:

an object area network comprising a plurality of object area network elements each having an inter-element communication unit adapted to facilitate inter-element communication between said object area network elements, said plurality of object area networks being each disposed on or proximate to said object;

ones of said object area network elements each having a sensing unit to obtain data related to the object and a processor adapted for processing sensed data and for controlling inter-element communications with other elements of said network;

a wireless communications unit coupled to at least one of said object area network elements and being adapted to facilitate communications between said object area network and at least one base station;

wherein said object area network elements are coupled by inter-element communication to form an object area network whereby information may be shared between said object area network elements, and wherein the information may be communicated between said object area network and said at least one base station via said wireless communication unit.

2. The monitoring and tracking system of claim 1, wherein at least one of said object area network elements has a global positioning system (GPS) unit, said GPS unit being adapted to supply position related data related to said object area network.

3. The monitoring and tracking system of claim 2, wherein said wireless communications unit is adapted to facilitate the calculation of positional data to said object area network.

4. The monitoring and tracking system of claim 2, wherein at least one object area network element includes said wireless communications unit, a sensing unit coupled to said wireless communications unit, and a GPS unit coupled to said wireless communications unit.

5. The monitoring and tracking system of claim 4, wherein said wireless communications unit, said sensing unit, and said GPS unit of said at least one object area network element are all disposed in a single package.

6. The monitoring and tracking unit of claim 2, further comprising:

a first data storage unit disposed proximate a first position, said first data storage unit adapted to store data related to the object; and a second data storage unit disposed proximate a second position, said second data storage unit adapted to store said data related to the object;

wherein said GPS unit is further adapted to process said position data related to said object area network such that when the object moves from the first position to the second position, said data related to the object is automatically transferred from said first data storage unit to said second data storage unit.

7. The monitoring and tracking system of claim 1, wherein ones of said sensing units comprise a sensing unit chosen from the group consisting of a temperature sensing unit, a pressure sensing unit and a sound sensing unit.

8. The monitoring and tracking system of claim 1, further comprising an alerting unit coupled to said wireless communications unit.

9. The monitoring and tracking system of claim 8, wherein the object is a person, said alerting unit being adapted to alert the person as a function of a signal transmitted by said base station;

wherein the person may be alerted to an impending danger.

10. The monitoring and tracking system of claim 1, wherein at least two of said object area network elements each include a GPS unit, said GPS units each being adapted to supply position data for said at least two object area network elements.

11. The monitoring and tracking system of claim 10, wherein said at least two of said object area network elements are adapted to calculate the distance between themselves.

12. The monitoring and tracking system of claim 1, wherein at least a first of said object area network elements is adapted to perform a diagnostic test on at least a second of said object area network elements.

13. The monitoring and tracking system of claim 1, wherein said communications between said object area network and said at least one base station include transmitting an emergency message to said at least one base station.

14. The monitoring and tracking system of claim 1, further comprising:

a first data storage unit disposed proximate a first position, said first data storage unit adapted to store data related to the object;

a second data storage unit disposed proximate a second position, said second data storage unit adapted to store said data related to the object; and a processing unit, said processing unit being adapted to process position data related to the object such that when the object moves from the first position to the second position, said data related to the object is automatically transferred from said first data storage unit to said second data storage unit.

15. A method for monitoring and tracking an object, said method comprising the steps of:

obtaining biometric data from sensing units coupled to ones of a plurality of object area network elements wherein said plurality of object area network elements are each disposed on or proximate to the object thereby forming a local area network relative to the object;

communicating element data between said plurality of object area network elements to insure that all object area network elements are present and said biometric data is within a predetermined range;

providing a processing means at ones of said plurality of object area network elements adapted to process said obtained biometric data and to control inter-element communications with other elements of said network; and communicating network data between said plurality of object area network elements and a base station by a wireless communication unit.

16. The method of claim 15, further comprising the step of:

obtaining position related data from at least one GPS unit which is part of one of said plurality of object area network elements.

17. The method of claim 16, further comprising:

storing personal data related to the object at a first data storage unit disposed proximate a first position;

processing said position related data obtained by said GPS unit related to the object with a processing unit; and automatically transferring said personal data related to the object from said first data storage unit to a second data storage unit when the object moves from said first position to a second position, said second data storage unit being disposed proximate said second position.

18. The method of claim 15, wherein ones of said sensing units comprise a unit chosen from the group consisting of a temperature sensing unit, a pressure sensing unit and a sound sensing unit.

19. The method of claim 15, wherein the object is a person, the method further comprising:

alerting the person to the existence of an impending danger as a function of a signal transmitted by the base station to an alerting unit on one of said plurality of object area network elements.

20. The method of claim 15, further comprising:

supplying position related data from a first GPS unit on a first of said plurality of object area network elements; and supplying position related data from a second GPS unit on a second of said plurality of object area network elements.

21. The method of claim 20, further comprising:

calculating the distance between said first of said plurality of object area network elements and said second of said plurality of object area network elements, by a processor unit which is incorporated in one of said plurality of object area network elements.

22. The method of claim 15, further comprising:

storing personal data related to the object at a first data storage unit disposed proximate a first position;

processing position data related to the object with a processing unit; and automatically transferring said personal data related to the object from said first data storage unit to a second data storage unit when the object moves from said first position to a second position, said second data storage unit being disposed proximate said second position.

23. An object area network, comprising:

a plurality of object area network element means disposed on or proximate to the object, each said element having inter-element communication means such that information may be shared between said two or more of said plurality of object area network means;

wherein, (i) ones of said plurality of object area network means each has means for sensing data related to the object and a processor adapted for processing sensed data and for controlling inter-element communications with other elements of said network;

(ii) at least one of said plurality of object area network means has wireless communication means for communicating between said object area network and at least one base station; and said two or more of said plurality of object area network element means communicate with each other as part of said object area network.

24. The monitoring and tracking system of claim 23, wherein at least one of said plurality of object area network element means has means for global positioning by way of at least one global positioning satellite, said means for global positioning being adapted to supply position related data to said object area network.

25. The monitoring and tracking unit of claim 24, further comprising:

a first means for data storage disposed proximate a first position, said first means for data storage being adapted to store personal data related to the object; and a second means for data storage disposed proximate a second position, said second means for data storage being adapted to store said personal data related to the object;

wherein said means for global positioning is further adapted to process said position data related to said object area network such that when the object moves from the first position to the second position, said personal data related to the object is automatically transferred from said first means for data storage to said second means for data storage.

26. The monitoring and tracking system of claim 23, wherein ones of said means for sensing comprise means chosen from the group consisting of a temperature sensing means, a pressure sensing means and a sound sensing means.

27. The monitoring and tracking system of claim 23, further comprising means for alerting.

28. The monitoring and tracking system of claim 27, wherein the object is a person, said means for alerting being adapted to alert the person of an impending danger as a function of a signal transmitted by said base station.

29. The monitoring and tracking system of claim 23, wherein at least two of said plurality of object area network elements have means for global positioning, said means for positioning being adapted to supply related position data for said at least two object area network elements.

30. The monitoring and tracking system of claim 23, further comprising:

a first means for data storage disposed proximate a first position, said first means for data storage being adapted to store personal data related to the object;

a second means for data storage disposed proximate a second position, said second means for data storage being adapted to store said personal data related to the object; and a means for processing, said means for processing being adapted to process position data related to the object such that when the object moves from the first position to the second position, said personal data related to the object is automatically transferred from said first means for data storage to said second means for data storage.

* * * * *